US007815450B1

(12) United States Patent
Chen et al.

(10) Patent No.: US 7,815,450 B1
(45) Date of Patent: Oct. 19, 2010

(54) ELECTRICAL CONNECTOR

(75) Inventors: Brad Yin-Hua Chen, Hsi Chih (TW); Arthur Mosier, Santa Ana, CA (US)

(73) Assignee: I/O Interconnect Inc., Santa Ana, CA (US)

( * ) Notice: Subject to any disclaimer, the term of this patent is extended or adjusted under 35 U.S.C. 154(b) by 0 days.

(21) Appl. No.: 12/618,640

(22) Filed: Nov. 13, 2009

(51) Int. Cl.
*H01R 27/00* (2006.01)

(52) U.S. Cl. ..... 439/218; 439/172

(58) Field of Classification Search ..... 439/135–137, 439/170–172, 217–218
See application file for complete search history.

(56) References Cited

U.S. PATENT DOCUMENTS 3,549,861 A * 12/1970 Trachtenberg et al. ..... 219/441
7,329,136 B2 * 2/2008 Su et al. ..... 439/172
7,452,221 B1 * 11/2008 Oddsen et al. ..... 439/137
7,645,149 B2 * 1/2010 Carbone et al. ..... 439/137
2009/0088024 A1 4/2009 Ling

* cited by examiner

*Primary Examiner*—Khiem Nguyen

(57) ABSTRACT

The present invention relates to an electrical connector, comprises a housing; a first connector; a second connector, wherein the second connector is disposed below the first connector and has a transmission speed different from the first connector; a driving member; an actuation rod; a driving spring; a lock sheet; an actuation spring; and a torsion spring. With the mentioned structure, the electrical connector is able to be plugged with a USB2.0 connector plug or a USB3.0 connector plug for satisfying requirements of various transmission speeds.

20 Claims, 8 Drawing Sheets

ELECTRICAL CONNECTOR

BACKGROUND OF THE INVENTION

1. Field of the Invention

The present invention relates to an electrical connector, more particularly to an electrical connector installed with a first USB connector and a second USB connector having different transmission speeds for satisfying requirements of various transmission speeds.

2. Description of Related Art

Periphery devices having USB interfaces are provided with plug-and-play functions, so once relative products are launched, they often catch consumers' attentions. The protocol of USB2.0 can provide a transmission speed up to 480M bit/sec. With developments of multi media technologies, downloading a 25 GB multi media file, with the USB2.0 protocol, may take a long time, so such low action could not really satisfy consumer's needs. Therefore the USB3.0 protocol has been established, the USB3.0 protocol can provide a transmission speed up to 4.8 G bit/sec, so downloading the same 25 G multi media file only take 1/10 of the consumed time of the USB2.0 protocol.

But the USB2.0 protocol is still the main stream in the market, and most of periphery devices installed with USB interfaces mainly support the USB2.0 protocol, so it is a crucial issue to design an electrical connector supporting both of the USB2.0 and USB3.0 protocols.

The US Patent Publication No. US2009/0088024A has disclosed a high speed connector and receptacle with backward compatibility to USB2.0, as disclosed in the abstract of said patent application, the connector plug includes a plurality of USB2.0 pins and one or more pins supporting high speed transmission, so the connector plug can support both of the USB2.0 and higher-speed USB plugs. As shown in FIG. 1 and FIG. 3 of the mentioned patent application, the plug and the socket of the connector respectively need a groove for preventing a false insertion, but such arrangement does not comply with the specification of USB2.0 protocol, the compatibility thereof is then lowered and production cost may be raised.

SUMMARY OF THE INVENTION

One primary object of the present invention is to provide an electrical connector installed with a first USB connector and a second USB connector having different transmission speeds for satisfying requirements of various transmission speeds.

For achieving the mentioned object, the present invention provides an electrical connector, comprises: a housing; a first connector received in the housing and one end thereof is exposed outside the housing; a second connector received in the housing and one end thereof is exposed outside the housing, wherein the second connector is disposed below the first connector and has a transmission speed different from the first connector; a driving member received in the housing and disposed at one side of the first connector, one end thereof is installed with an accommodation room, the rear end of the accommodation room is installed with a tenon; an actuation rod received in the accommodation room, one end thereof is exposed outside the accommodation room and is aligned with the second connector; a driving spring installed at the exterior of the accommodation room; a lock sheet disposed on top of the driving member and has a lock slot for receiving the tenon; an actuation spring received in the accommodation room and installed at the exterior of the actuation rod; and a torsion spring installed at one side of the housing, one end thereof is abutted against the bottom end of the first connector.

For achieving the mentioned object, the present invention also provides an electrical connector, comprises: a housing having an upper housing and a lower housing, the upper housing is able to be engaged with the lower housing, and the lower housing is installed with a chamber, one side of the lower housing is installed with a round column; a first connector received in the chamber and one end thereof is exposed outside the housing, the other end thereof is extended with a fastening sheet; a second connector received in the chamber and one end thereof is exposed outside the housing, wherein the second connector is disposed below the first connector and has a transmission speed different from the first connector; an actuation rod received in the chamber and disposed at one side of the first connector, one end thereof is installed with an actuation slot for receiving the round column, the other end thereof is exposed outside the lower housing and is aligned with the second connector, a tenon is installed thereon; a lock sheet installed on the top end of the actuation rod and has a lock slot for receiving the tenon; an actuation spring installed at the exterior of the round column, one end thereof is abutted against the actuation slot; and a resilient member received in the chamber, one end thereof is fastened in the lower housing, the other end thereof is fastened on the fastening sheet.

DETAILED DESCRIPTION OF THE PREFERRED EMBODIMENT

Figure 1:
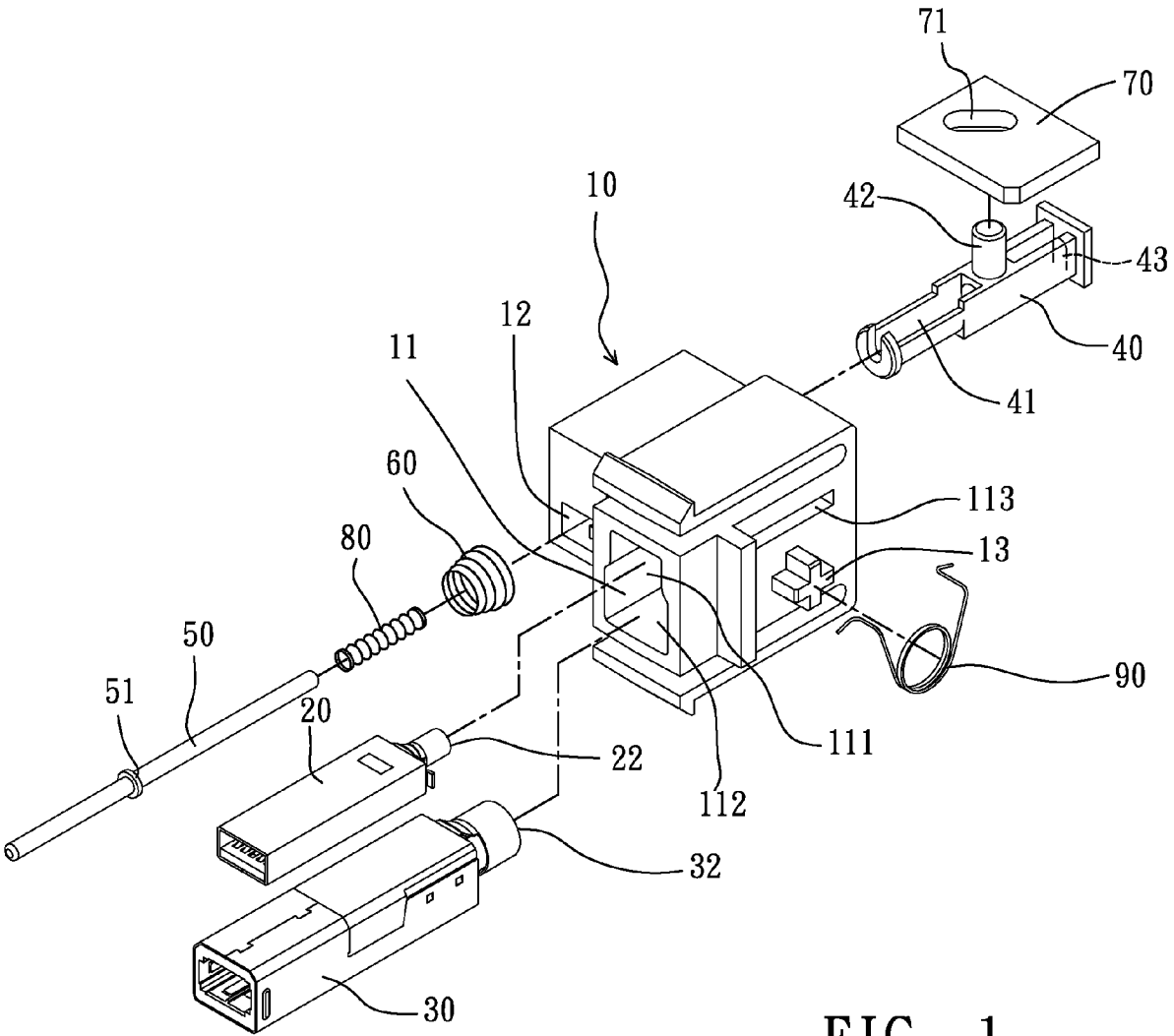
FIG. 1 is a schematic exploded view of the electrical connector of one embodiment of the present invention.
Figure 2:
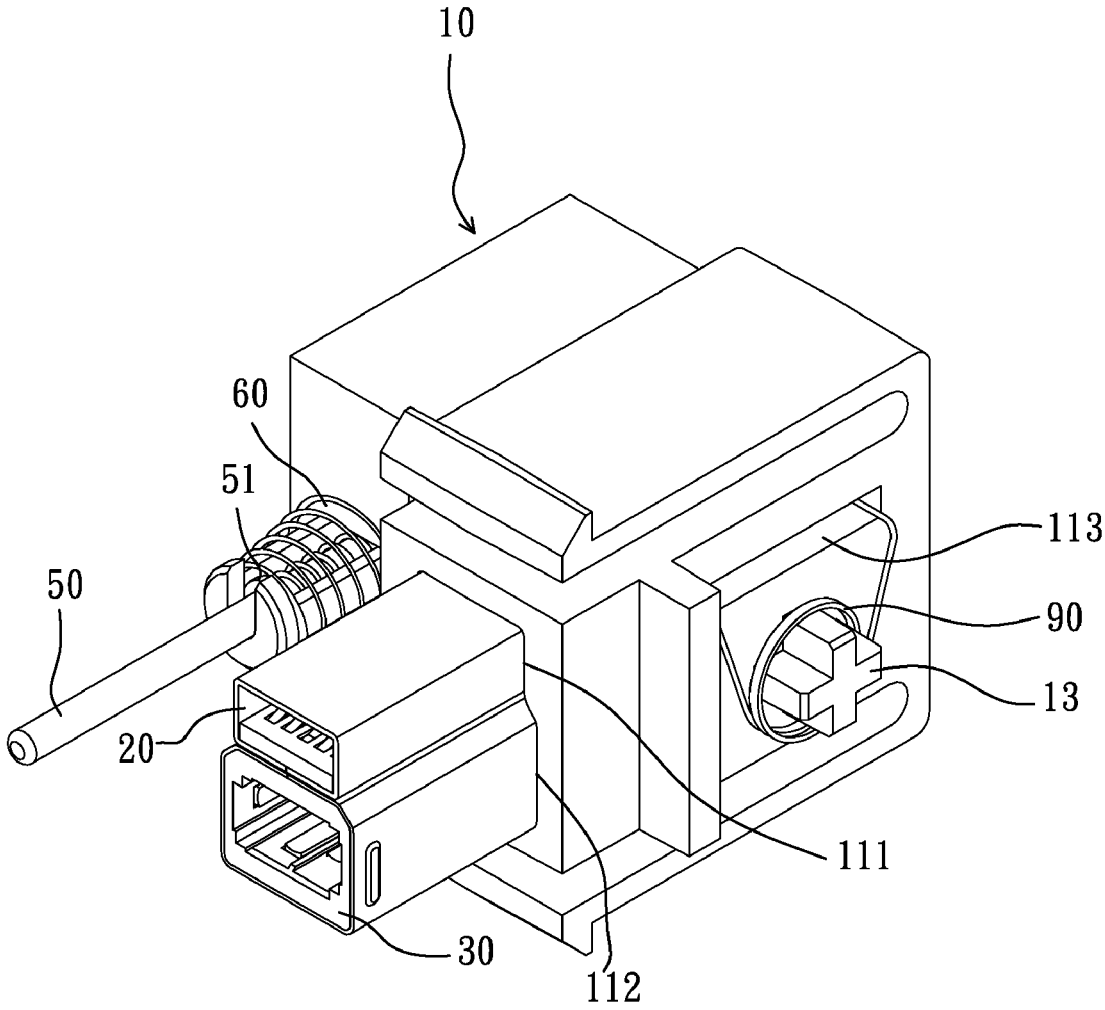
FIG. 2 is a perspective view of the assembly of the electrical connector of one embodiment of the present invention.
Figure 3:
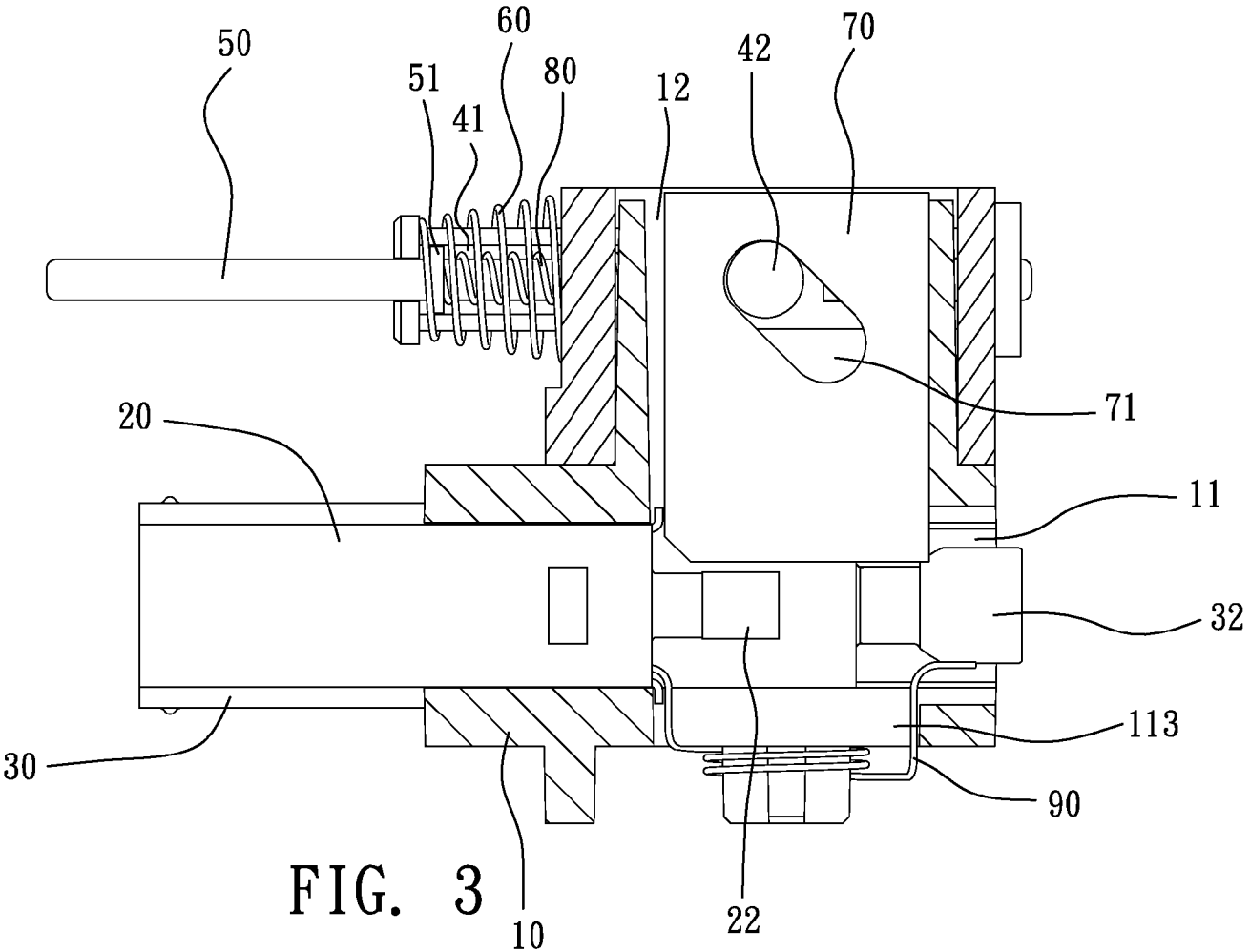
FIG. 3 is a schematic view illustrating the action of locking status of the electrical connector of one embodiment of the present invention.
Figure 4:
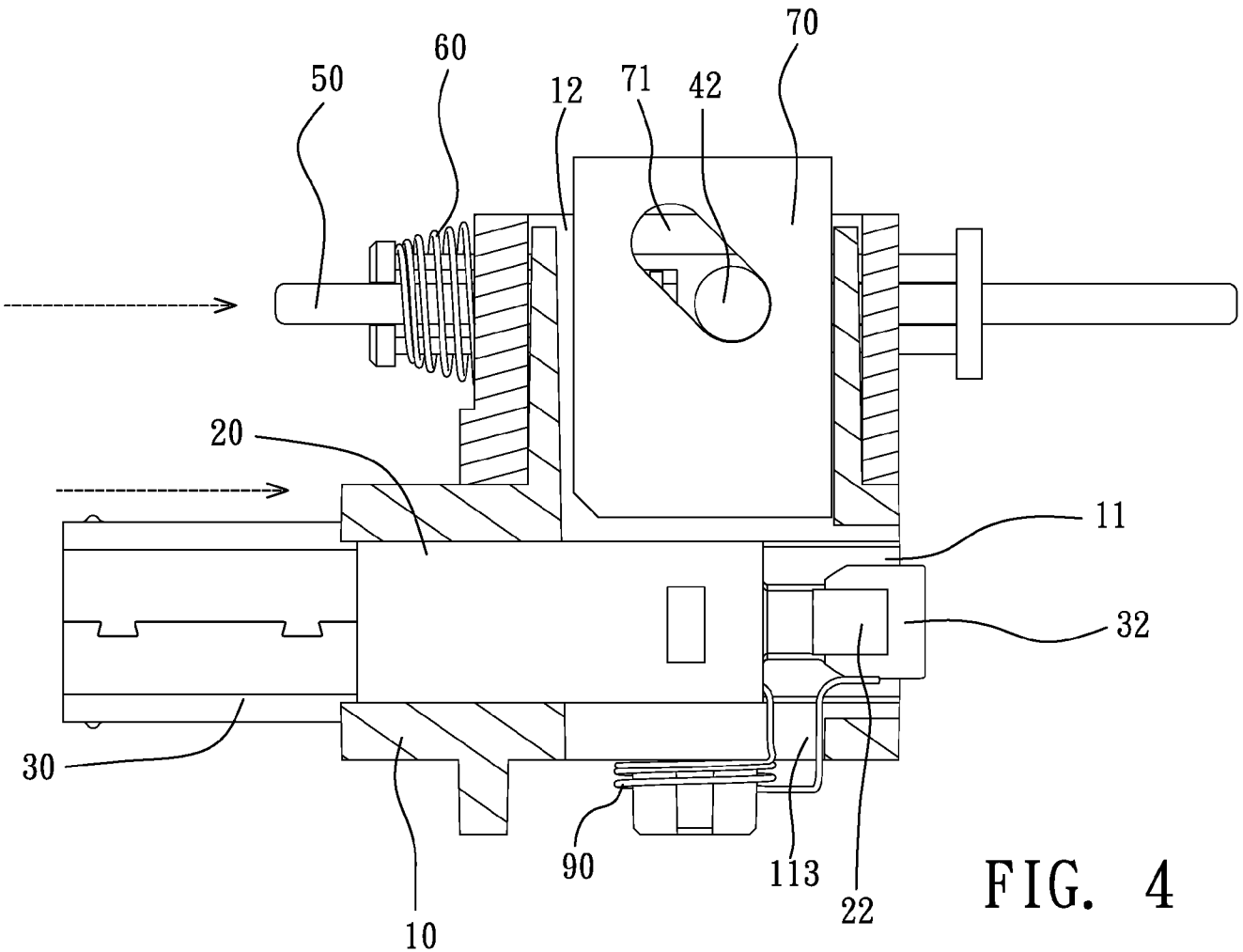
FIG. 4 is a schematic view illustrating the action of unlocking status of the electrical connector of one embodiment of the present invention.

Referring from FIG. 1 to FIG. 4, wherein FIG. 1 is a schematic exploded view of the electrical connector of one embodiment of the present invention; FIG. 2 is a perspective view of the assembly of the electrical connector of one embodiment of the present invention; FIG. 3 is a schematic view illustrating the action of locking status of the electrical connector of one embodiment of the present invention; FIG. 4 is a schematic view illustrating the action of unlocking status of the electrical connector of one embodiment of the present invention.

As shown in figures, the electrical connector provided by the present invention comprises: a housing 10, a first connector 20, a second connector 30, a driving member 40, an actuation rod 50, a driving spring 60, a lock sheet 70, an actuation spring 80 and a torsion spring 90.

The housing 10 is made of insulation material, e.g. but not to plastic material, and is further installed with a first chamber 11 and a second chamber 12; two ends of the first chamber 11 is further provided with a first guide slot 111 and a second guide slot 112, the first guide slot 111 is provided for guiding the first connector 20 to be received in the first chamber 11, the second guide slot 112 is provided for guiding the second connector 30 to be received in the first chamber 11, the second chamber 12 is disposed at one side of the first chamber 11, e.g. but not limited to the right side, for receiving the lock sheet 70.

The first connector 20 is installed in the housing 10, and one end thereof is exposed outside the housing 10; wherein the first connector 20 is, e.g. but not limited to, a USB3.0 connector and a wire hole 22 is installed at the rear end thereof and the wire hole 22 is exposed outside the housing 10, for receiving a USB3.0 cable (not shown) and entering the first USB connector 20.

The second connector 30 is installed in the housing 10, and one end thereof is exposed outside the housing 10; wherein the second connector 30 is disposed below the first connector 20 and the transmission speed thereof is different from that of the first connector 20; wherein the second connector 30 is, e.g. but not limited to, a USB2.0 connector, a wire hole 32 is installed at the rear end thereof and the wire hole 32 is exposed outside the housing 10, for receiving a USB2.0 cable and entering.

The driving member 40 is installed in the housing 10 and disposed at one side of the first connector 20, e.g. but not limited to the right side, one end thereof is installed with an accommodation room 41, the rear end of the accommodation room 41 is further installed with a tenon 42. The rear end of the driving member 40 is further installed with a notch 43 so that one end of the actuation rod 50 is able to pass through.

The actuation rod 50 is received in the accommodation room 41, and one end thereof is exposed outside the accommodation room 41 and is aligned with the second connector 30, the other end of the actuation rod 50 passes through the notch 43. The actuation rod 50 is further provided with a latching portion 51 in a round shape and having an outer diameter larger than the actuation spring 80 for pressing the actuation spring 80 during movement.

The driving spring 60 is installed at the exterior of the accommodation room 41; the driving member 40 is able to be recovered through the elastic force of the driving spring 60.

The lock sheet 70 is disposed on top of the driving member 40, and has a lock slot 71 for receiving the tenon 42, and the lock slot 71 is installed in an oblique means.

The actuation spring 80 is received in the accommodation room 41 and installed at the exterior of the actuation rod 50, so the actuation rod 50 is able to be recovered through the elastic force of the actuation spring 80.

The torsion spring 90 is installed at one side of the housing 10, e.g. but not limited to the left side, one end thereof is abutted against the bottom end of the first connector 20, the other end thereof is abutted against the housing 10; wherein the torsion spring 90 is, e.g. but not limited to, a metal-made spring.

The first chamber 11 of the present invention is further installed with an open slot 113, and a cross-shaped convex sheet 13 is installed on the housing 10 and below the open slot 113, so the torsion spring 90 is able to be installed at the exterior of the cross-shaped convex sheet 13, two ends of the torsion spring 90 are respectively disposed in the open slot 113, wherein one end thereof is abutted against the bottom end of the first connector 20 through one end of the open slot 113, the other end is abutted against the other end of the open slot 113 so as to fasten the torsion spring 90 on the housing 10.

As shown in FIG. 3, after being assembled, when a USB2.0 device (not shown) is inserted in the second connector 30, one end of the USB2.0 device is abutted against the actuation rod 50, so when the USB2.0 device is further forwardly moved, the actuation rod 50 is driven to forwardly move about 8-12 mm and the actuation spring 80 is driven to move about 3 mm, and the tenon 42 is synchronously and leftwardly moved 3 mm for entering an unlock position, so as to unlock the first connector 20, and the USB2.0 device presses the first connector 20 into the housing 10 so the USB2.0 device is able to be directly connected to the second connector 30.

As shown in FIG. 4, when the USB2.0 device is removed from the second connector 30, the first connector 20 is forwardly pushed through the elastic force of the torsion spring 90, and the tenon 42 is rightwardly moved 3 mm for entering a lock position, so that the first connector 20 is locked, and the actuation rod 50 is forwardly moved to its original position through the elastic force of the driving spring 60, so a USB3.0 device (not shown) is able to be inserted in the first connector 20. The present invention provides the first USB connector 20 and the second USB connector 30 having a different transmission speed regarding to the first USB connector 20, therefore requirements of different transmission speeds are satisfied, and is novel compared to conventional electrical connectors.

Figure 5:
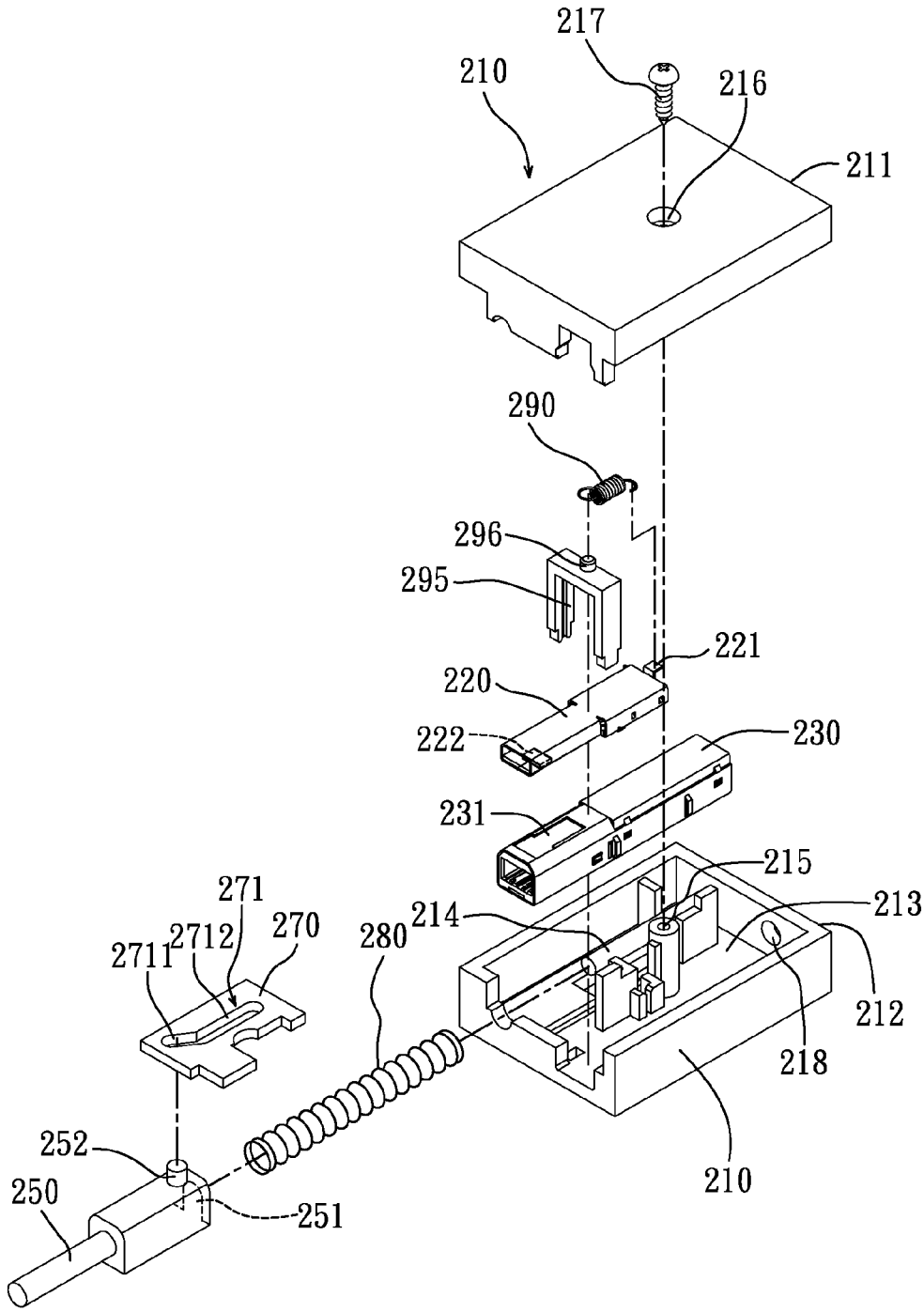
FIG. 5 is a schematic exploded view of the electrical connector of another embodiment of the present invention.
Figure 6:
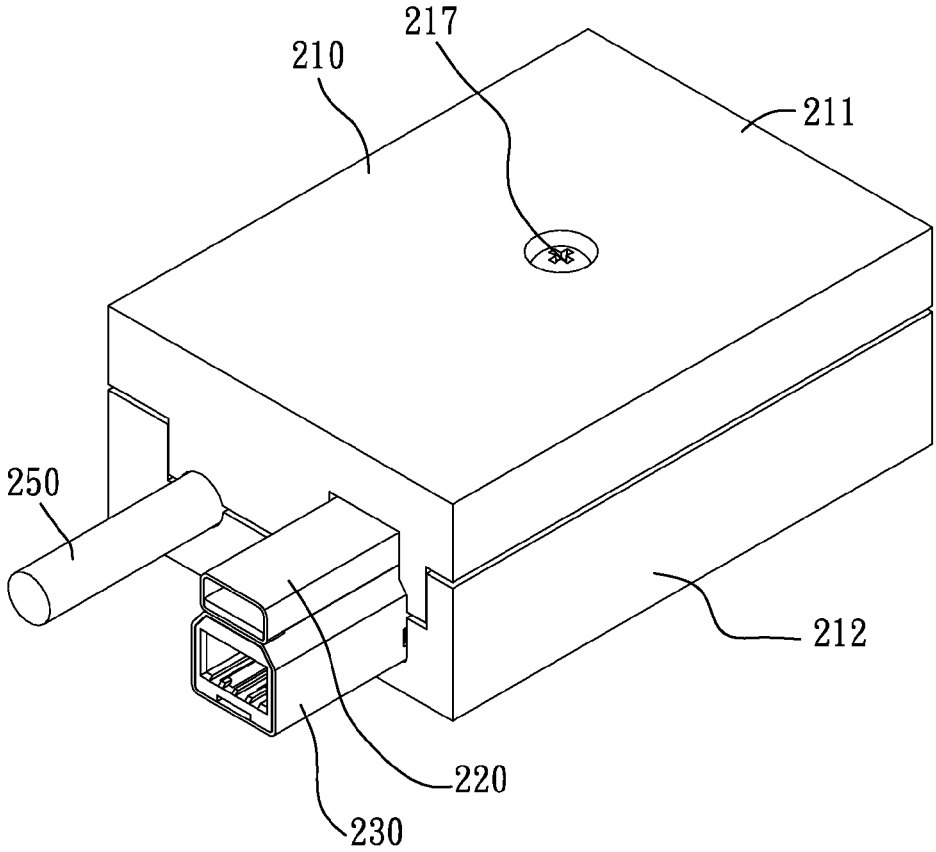
FIG. 6 is a perspective view of the assembly of the electrical connector of another embodiment of the present invention.
Figure 7:
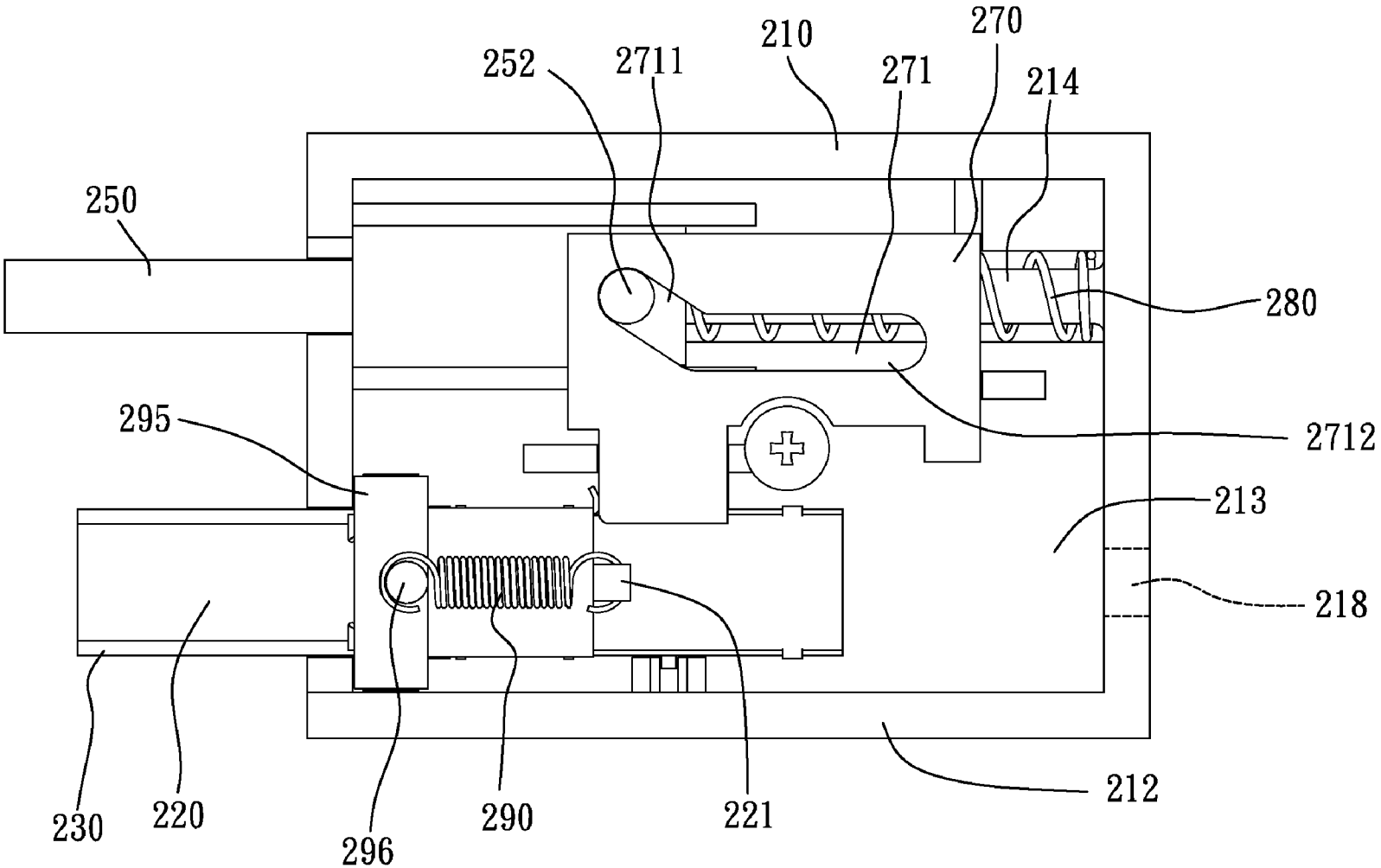
FIG. 7 is a schematic view illustrating the action of locking status of the electrical connector of another embodiment of the present invention.
Figure 8:
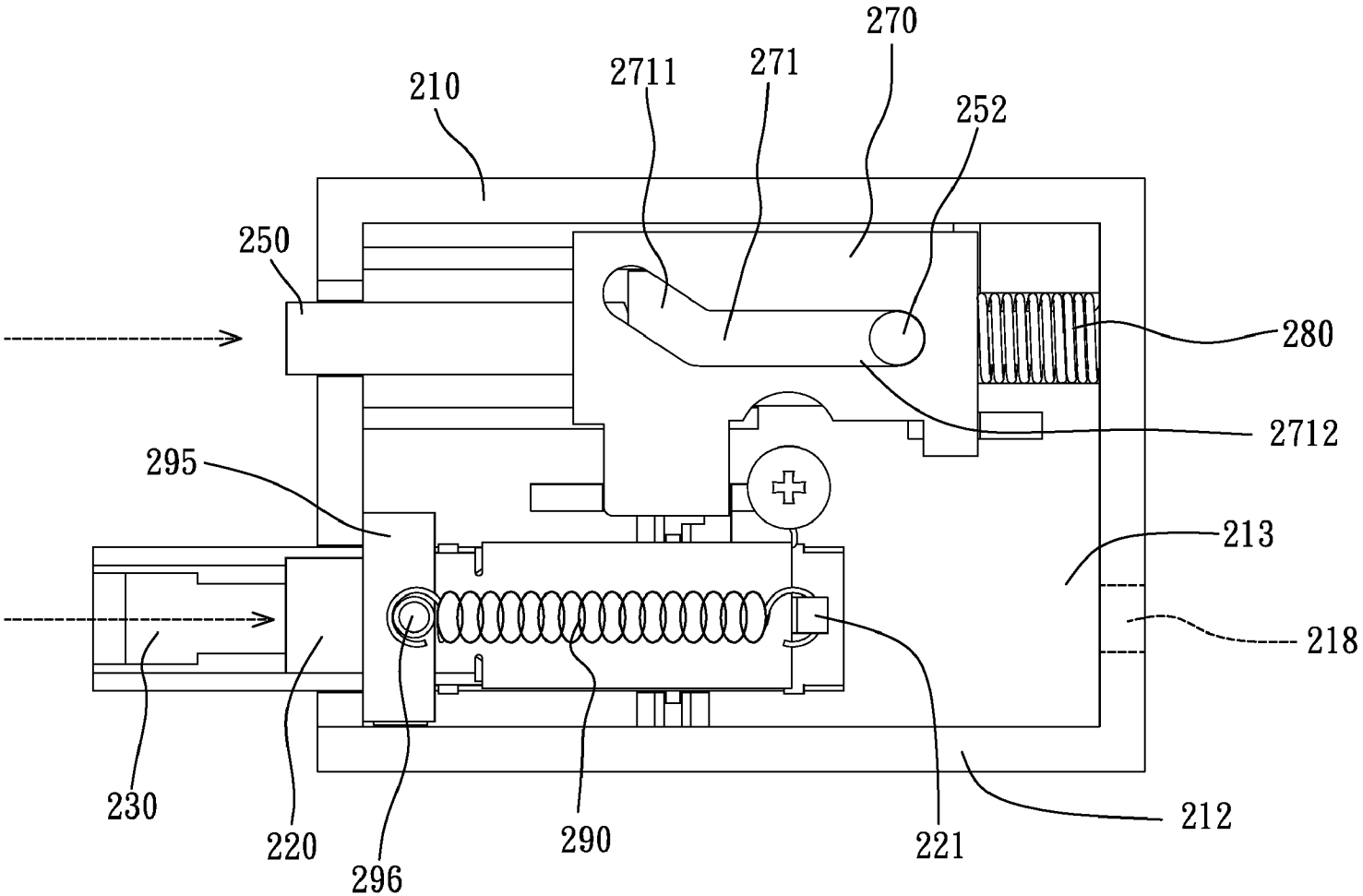
FIG. 8 is a schematic view illustrating the action of unlocking status of the electrical connector of another embodiment of the present invention.

Referring from FIG. 5 to FIG. 8, wherein FIG. 5 is a schematic exploded view of the electrical connector of another embodiment of the present invention; FIG. 6 is a perspective view of the assembly of the electrical connector of another embodiment of the present invention; FIG. 7 is a schematic view illustrating the action of locking status of the electrical connector of another embodiment of the present invention; FIG. 8 is a schematic view illustrating the action of unlocking status of the electrical connector of another embodiment of the present invention.

As shown in figures, another embodiment of the electrical connector of the present invention comprises: a housing 210, a first connector 220, a second connector 230, an actuation rod 250, a lock sheet 270, an actuation spring 280 and a resilient member 290.

The housing 210 is made of insulation material, e.g. but not limited to plastic material, and is further installed with an upper housing 211 and a lower housing 212, the upper housing 211 is able to be engaged with the lower housing 212, and the lower housing 212 is provided with a chamber 213, a round column 214 is installed at one side of the lower housing 212, the round column 214 is connected to one side of the lower housing 212 and is spaced away from the bottom end of the lower housing 212 with an interval, so the actuation spring 280 is able to move on the round column 214.

The lower housing 212 is further installed with a lock base 215, the upper housing 211 is installed with a lock hole 216, so a screw 217 can be used to pass through the lock hole 216 for fastening the upper housing 211 to the lower housing 212. One side of the lower housing 212 is installed with a wire hole 218 for allowing a USB cable passing and entering the first connector 220 and the second connector 230.

The first connector 220 is received in the chamber 213, one end thereof is exposed outside the housing 210, the other end thereof is extended with a fastening sheet 221 along a horizontal direction; wherein the first connector 220 is, e.g. but not limited to, a USB3.0 connector, and the bottom end thereof is installed with a guiding protrusion 222, e.g. but not limited to a rectangular guiding protrusion.

The second connector 230 is received in the chamber 213 and one end thereof is exposed outside the housing 210; wherein the second connector 230 is disposed below the first connector 220, and has a different transmission speed regarding to the first connector 220; wherein the second connector 230 is, e.g. but not limited to, a USB2.0 connector, the top end thereof is installed with a concave slot 231 for allowing the guiding protrusion 222 fastening and sliding.

The actuation rod 250 is received in the chamber 213 and is disposed at one side of the first connector 220, e.g. but not limited to the right side, a bottom portion of one end thereof is installed with an actuation slot 251 for receiving the round column 214, the other end thereof is exposed outside the lowering housing 212 and is aligned with the second connector 230, a tenon 252 is installed thereon.

The lock sheet 270 is disposed on top of the actuation rod 250, and has a lock slot 271 for receiving the tenon 252, and the lock slot 271 is installed in an oblique means. The lock slot 271 is defined as a bended portion 2711 and a linear portion 2712, and the length of the bended portion 2711 is, e.g. but not limited to, 3 mm.

The actuation spring 280 is installed at the exterior of the round column 214, one end thereof is abutted against the actuation slot 251, so the actuation rod 250 is able to be recovered through the elastic force of the actuation spring 280.

The resilient member 290 is installed in the chamber 213, end of thereof is fastened on the lower housing 212, the other end thereof is fastened on the fastening sheet 221; wherein the resilient member 290 is, e.g. but not limited to, a metal-made spring.

Moreover, the electrical connector of the present invention is further installed with a U-shaped block sheet 295 fastened on the top end of the first connector 220, and a convex column 296 is installed thereon for fastening the other end of the resilient remember 290.

As shown in FIG. 7, after being assembled, when a USB2.0 device (not shown) is inserted in the second connector 230, one side of the USB2.0 device is abutted against the actuation rod 250, when the USB2.0 device is further forwardly moved, the actuation rod 250 is driven to forwardly move about 8-12 mm, and the actuation spring 280 is driven to upwardly move about 8-12 mm on the round column 214, so that the actuation spring 280 is compressed, and the tenon 252 is synchronously moved in the bended portion 2711, the lock sheet 270 is therefore driven to rightwardly move 3 mm for entering an unlock position, so as to unlock the first connector 220, and the first connector 220 is pressed into the housing 210 through the USB2.0 device.

As shown in FIG. 8, when the USB2.0 device is removed from the second connector 230, the actuation rod 250 is forwardly pushed to its original position through the elastic force of the actuation spring 280, and the tenon 252 is driven to rightwardly move about 3 mm for entering a lock position, the first connector 220 is forwardly pushed through the elastic force of the resilient member 290, and one corner of the lock sheet 270 is served to block the first connector 220 so as to lock the first connector 220. Thus, this another embodiment of the present invention provides the first USB connector 220 and the second USB connector 230 having a different transmission speed regarding to the first USB connector 220, therefore requirements of different transmission speeds are satisfied, and is novel compared to conventional electrical connectors.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a housing;

a first connector received in the housing and one end thereof being exposed outside the housing;

a second connector received in the housing and one end thereof being exposed outside the housing, wherein the second connector being disposed below the first connector and having a transmission speed different from the first connector;

a driving member received in the housing and disposed at one side of the first connector, one end thereof being installed with an accommodation room, the rear end of the accommodation room being installed with a tenon;

an actuation rod received in the accommodation room, one end thereof being exposed outside the accommodation room;

a driving spring installed at the exterior of the accommodation room;

a lock sheet disposed on top of the driving member and having a lock slot for receiving the tenon;

an actuation spring received in the accommodation room and installed at the exterior of the actuation rod; and a torsion spring installed at one side of the housing, one end thereof is abutted against the bottom end of the first connector.

2. The electrical connector as claimed in claim 1, wherein the housing is made of insulation material, said insulation material is plastic, and is further installed with a first chamber and a second chamber, two ends of the first chamber are further installed with a first guide slot and a second guide slot, the first guide slot is provided for guiding the first connector to be received in the first chamber, the second guide slot is provided for guiding the second connector to be received in the first chamber, the second chamber is disposed at one side of the first chamber for receiving the lock sheet.

3. The electrical connector as claimed in claim 1, wherein the first connector is a USB3.0 connector, a rear end thereof is installed with a wire hole exposed outside the housing for allowing a USB3.0 cable passing and entering the first USB connector.

4. The electrical connector as claimed in claim 3, wherein the second connector is a USB2.0 connector, a rear end thereof is installed with a wire hole exposed outside the housing for allowing a USB2.0 cable passing and entering the second USB connector.

5. The electrical connector as claimed in claim 1, wherein the rear end of the driving member is installed with a notch for allowing one end of the actuation rod passing through.

6. The electrical connector as claimed in claim 1, wherein the actuation rod is aligned with the second connector and is further installed with a latching portion in a round shape and having an outer diameter larger than the actuation spring for compressing the actuation spring during movement.

7. The electrical connector as claimed in claim 6, wherein when a USB2.0 device is inserted in the second connector, one end of the USB2.0 device is abutted against the actuation rod, so when the USB2.0 device is further forwardly moved, the actuation rod is driven to forwardly move about 8-12 mm and the actuation spring is driven to move about 3 mm, and the tenon is synchronously and leftwardly moved 3 mm for entering an unlock position, so as to unlock the first connector, and the USB2.0 device presses the first connector into the housing.

8. The electrical connector as claimed in claim 7, wherein when the USB2.0 device is removed from the second connector, the first connector is forwardly pushed through the elastic force of the torsion spring, and the tenon is rightwardly moved 3 mm for entering a lock position, so as to lock the first connector, and the actuation rod is forwardly moved to its original position through the elastic force of the driving spring.

9. The electrical connector as claimed in claim 2, wherein one side of the first chamber is further installed with an open slot, and a cross-shaped convex sheet is installed on the housing and below the open slot, so the torsion spring is installed at the exterior of the cross-shaped convex sheet, two ends of the torsion spring are respectively installed in the open slot, wherein one end thereof is abutted against the bottom end of the first connector so as to fasten the torsion spring on the housing.

10. The electrical connector as claimed in claim 1, wherein the torsion spring is a metal-made spring.

11. An electrical connector, comprising:

a housing having an upper housing and a lower housing, the upper housing being able to be engaged with the lower housing, and the lower housing being installed with a chamber, one side of the lower housing being installed with a round column;

a first connector received in the chamber and one end thereof being exposed outside the housing, the other end thereof being extended with a fastening sheet;

a second connector received in the chamber and one end thereof being exposed outside the housing, wherein the second connector being disposed below the first connector and has a transmission speed different from the first connector;

an actuation rod received in the chamber and disposed at one side of the first connector, one end thereof being installed with an actuation slot for receiving the round column, the other end thereof being exposed outside the lower housing, a tenon being installed thereon;

a lock sheet installed on the top end of the actuation rod and has a lock slot for receiving the tenon;

an actuation spring installed at the exterior of the round column, one end thereof being abutted against the actuation slot; and a resilient member received in the chamber, one end thereof being fastened in the lower housing, the other end thereof being fastened on the fastening sheet.

12. The electrical connector as claimed in claim 11, wherein the housing is made of insulation material, said insulation material is plastic, and the lower housing is installed with a lock base, the upper housing is installed with a lock hole, and a screw is used to passed through the lock hole for fastening the upper housing to the lower housing.

13. The electrical connector as claimed in claim 11, wherein further installed with a U-shaped block sheet fastened on top of the first connector, and a convex column is installed thereon for fastening the other end of the resilient member.

14. The electrical connector as claimed in claim 11, wherein the first connector is a USB3.0 connector, a bottom end thereof is installed with a guiding protrusion, and a wire hole is installed at one side of the lower housing for allowing a USB3.0 cable passing and entering the first connector.

15. The electrical connector as claimed in claim 14, wherein the second connector is a USB2.0 connector, a top end thereof is installed with a concave slot for allowing the guiding protrusion fastening and sliding, and the wire hole is provided for allowing a USB2.0 cable passing and entering the second connector.

16. The electrical connector as claimed in claim 11, wherein the lock slot is defined as a bended portion and a linear portion, and the length of the bended portion is 3 mm.

17. The electrical connector as claimed in claim 16, wherein when a USB2.0 device is inserted in the second connector, one end of the USB2.0 device is abutted against the actuation rod, so when the USB2.0 device is further forwardly moved, the actuation rod is driven to forwardly move about 8-12 mm and the actuation spring is driven to move about 8-12 mm on the round column, so that the actuation spring is compressed, and the tenon is synchronously moved in the bended portion, the lock sheet is therefore driven to rightwardly move 3 mm for entering an unlock position, so as to unlock the first connector, and the first connector is pressed into the housing through the USB2.0 device.

18. The electrical connector as claimed in claim 16, wherein when the USB2.0 device is removed from the second connector, the actuation rod is forwardly moved to its original position through the elastic force of the actuation spring, and the tenon is driven to rightwardly move about 3 mm for entering a lock position, the first connector is forwardly pushed through the elastic force of the resilient member, so as to lock the first connector.

19. The electrical connector as claimed in claim 11, wherein the resilient member is a metal-made spring.

20. The electrical connector as claimed in claim 11, wherein the actuation rod is aligned with the second connector.

* * * * *